US007450089B2

(12) United States Patent
Son

(10) Patent No.: US 7,450,089 B2
(45) Date of Patent: Nov. 11, 2008

(54) PLASMA DISPLAY PANEL AND METHOD FOR DRIVING THE SAME

(75) Inventor: Jin-Boo Son, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 600 days.

(21) Appl. No.: 10/930,945

(22) Filed: Sep. 1, 2004

(65) Prior Publication Data

US 2005/0057449 A1 Mar. 17, 2005

(30) Foreign Application Priority Data

Sep. 2, 2003 (KR) ..... 10-2003-0061187

(51) Int. Cl.
*G09G 3/28* (2006.01)

(52) U.S. Cl. ..... 345/60

(58) Field of Classification Search ..... 345/60–72
See application file for complete search history.

(56) References Cited

U.S. PATENT DOCUMENTS 5,049,865 A * 9/1991 Nakamura et al. ..... 345/60
6,496,163 B1 * 12/2002 Iseki ..... 345/60
6,559,819 B1 * 5/2003 Rumbaugh et al. ..... 345/75.2
7,176,912 B2 * 2/2007 Kota et al. ..... 345/211
2002/0036633 A1 * 3/2002 Kasahara et al. ..... 345/204
2003/0197661 A1 * 10/2003 Choi ..... 345/60

FOREIGN PATENT DOCUMENTS

| | | |
|---|---|---|
| CN | 1450516 | 10/2003 |
| JP | 2001-045524 | 2/2001 |
| JP | 2002-131720 | 5/2002 |

* cited by examiner

*Primary Examiner*—Bipin Shalwala
*Assistant Examiner*—Steven E Holton
(74) *Attorney, Agent, or Firm*—H.C. Park & Associates, PLC

(57) ABSTRACT

An improved plasma display panel and a method for driving the same are disclosed. Illustratively, the plasma display panel includes a plurality of address electrodes and a plurality of scan electrodes and sustain electrodes, and displays video data through dual scanning. A temperature sensor included in the plasma display panel detects a temperature of the plasma display panel. When the detected temperature is determined to be low, a scanning direction in which a voltage is applied to the scan electrodes is controlled such that the plasma panel is scanned from both ends to the center. When the detected temperature is determined to be high, a scanning direction in which a voltage is applied to the scan electrodes is controlled such that the plasma panel is scanned from a top towards the center. Altering the scan direction based on temperature improves picture quality.

15 Claims, 3 Drawing Sheets

<Normal temperature>

<Low temperature>

PLASMA DISPLAY PANEL AND METHOD FOR DRIVING THE SAME

CROSS REFERENCE TO RELATED APPLICATION

This application claims priority of Korea Patent Application No. 2003-61187 filed on Sep. 2, 2003 in the Korean Intellectual Property Office, the content of which is herein incorporated by reference.

BACKGROUND OF THE INVENTION

1. Field of the Invention

The present invention relates to a plasma display panel, and more particularly, to a plasma display panel (PDP) whose scanning direction can be controlled in response to a detected operating temperature. A method for driving the PDP in response to a detected operating temperature is also disclosed.

2. Description of the Related Art

A plasma display panel is a flat panel display that displays characters or images using plasma generated by gas discharge. The plasma display panel is constructed in a manner such that more than hundreds of thousands to millions of pixels are arranged in a matrix form depending on the size of the panel. PDPs are classified as a Direct Current (DC) or an Alternating Current (AC) type based on the waveform of a driving voltage applied thereto and the structure of the display's discharge cells.

In general, an AC type plasma display panel is driven using a reset interval, an addressing interval, and a sustain interval. The reset interval erases wall charges formed by a previous sustain discharge, and initializes a state of each cell to smoothly carry out a next addressing operation. The addressing interval discriminates addressed cells in the panel from non-addressed cells and accumulates wall charges in the addressed cells. The sustain interval carries out the discharge to display an image on each addressed cell. During the sustain interval, a sustain pulse is alternately applied to a scan electrode and a sustain electrode to create the sustain discharge to display an image on the panel.

When the plasma display panel is driven, a scanning direction of a scan electrode driver is set in one direction. This generates a discharge difference depending on whether the first scanning line is located in the center or edge of the plasma display panel, or creates a discharge difference between the first scanning line and the last scanning line. Accordingly, one of two disadvantages occurs. The discharge difference either reduces a margin of the plasma display panel or generates a luminance difference between upper and lower parts of the plasma display panel, both of which adversely affect image quality.

The luminance difference between the upper and lower parts of the panel may be reduced or eliminated by scanning the PDP from the center outwards to the ends thereof. However, the discharge characteristics of a center-scanned PDP vary at a low or high operating temperature and generate an unstable discharging operation of the first scanning line. Accordingly, poor discharge occurs in scanning lines located in the center of the panel, which adversely affects image clarity and quality. A solution is needed that improves a PDP's discharge characteristics at low and high operating temperatures.

SUMMARY OF THE INVENTION

Embodiments of the present invention provide a plasma display panel and a method for driving the same in which the plasma display panel, in response to a detected low or high operating temperature, is scanned starting from the end thereof to reduce the influence of that poor discharge of the first scanning line has on images.

In one aspect of the present invention, a plasma display panel that receives external video data and displays gray scales through dual scanning includes a plasma panel having a plurality of address electrodes, a plurality of scan electrodes, and a plurality of sustain electrodes. The PDP further includes a temperature sensor for sensing a temperature of the plasma panel, and a controller that receives video data to generate an address electrode driving signal, a sustain electrode driving signal, and a scan electrode driving signal. In response to a detected low or high temperature, the controller may alter a scanning direction such that the PDP is scanned from an end thereof to the center of the panel. For example, the controller may also rearrange the address electrode driving signal that corresponds to the controlled scanning direction when the temperature sensed by the temperature sensor is lower than a first temperature. The PDP may further include an address electrode driver that applies a voltage corresponding to the address electrode driving signal to the address electrodes; a sustain electrode driver that applies a sustain voltage to the sustain electrodes in response to the sustain electrode driving signal of the controller; and a scan electrode driver that determines a scanning direction according to a control signal of the controller and applies a voltage to the scan electrodes in response to the scan electrode driving signal.

In another aspect of the present invention, a plasma display panel that receives external video data and displays gray scales includes a plasma panel having a plurality of address electrodes, a plurality of scan electrodes, and a plurality of sustain electrode. The PDP may further include a temperature sensor for sensing a temperature of the plasma panel, and a controller that receives the video data to generate an address electrode driving signal, a sustain electrode driving signal, and a scan electrode driving signal. The controller may change a scanning direction when the temperature sensed by the temperature sensor is higher than a first temperature or lower than a second temperature. The PDP may further include an address electrode driver that applies a voltage corresponding to the address electrode driving signal to the address electrodes; a sustain electrode driver that applies a sustain voltage to the sustain electrodes in response to the sustain electrode driving signal of the controller; and a scan electrode driver that determines a scanning direction according to a control signal of the controller and applies a voltage to the scan electrodes in response to the scan electrode driving signal.

Another aspect of the present invention discloses a method for driving a plasma display panel that includes a plurality of address electrodes and a plurality of scan electrodes and sustain electrodes and that displays video data through dual scanning. Illustratively, the method may include: sensing a temperature of the plasma display panel, and receiving external video data to generate an address electrode driving signal, a sustain electrode driving signal, and a scan electrode driving signal. The method may further include altering a first scanning direction in response to a detected temperature such that the plasma display panel is scanned from both ends to the center thereof. For example, the address electrode driving signal may be rearranged in response to the altered scanning direction when the sensed temperature is lower than a first temperature. The method may further include applying a rearranged address electrode driving signal to the address electrodes, applying a sustain voltage to the sustain electrodes in response to the sustain electrode driving signal, and applying, in response to a control signal, a voltage to the scan electrodes that varies according to the scan electrode driving signal.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Figure 1:
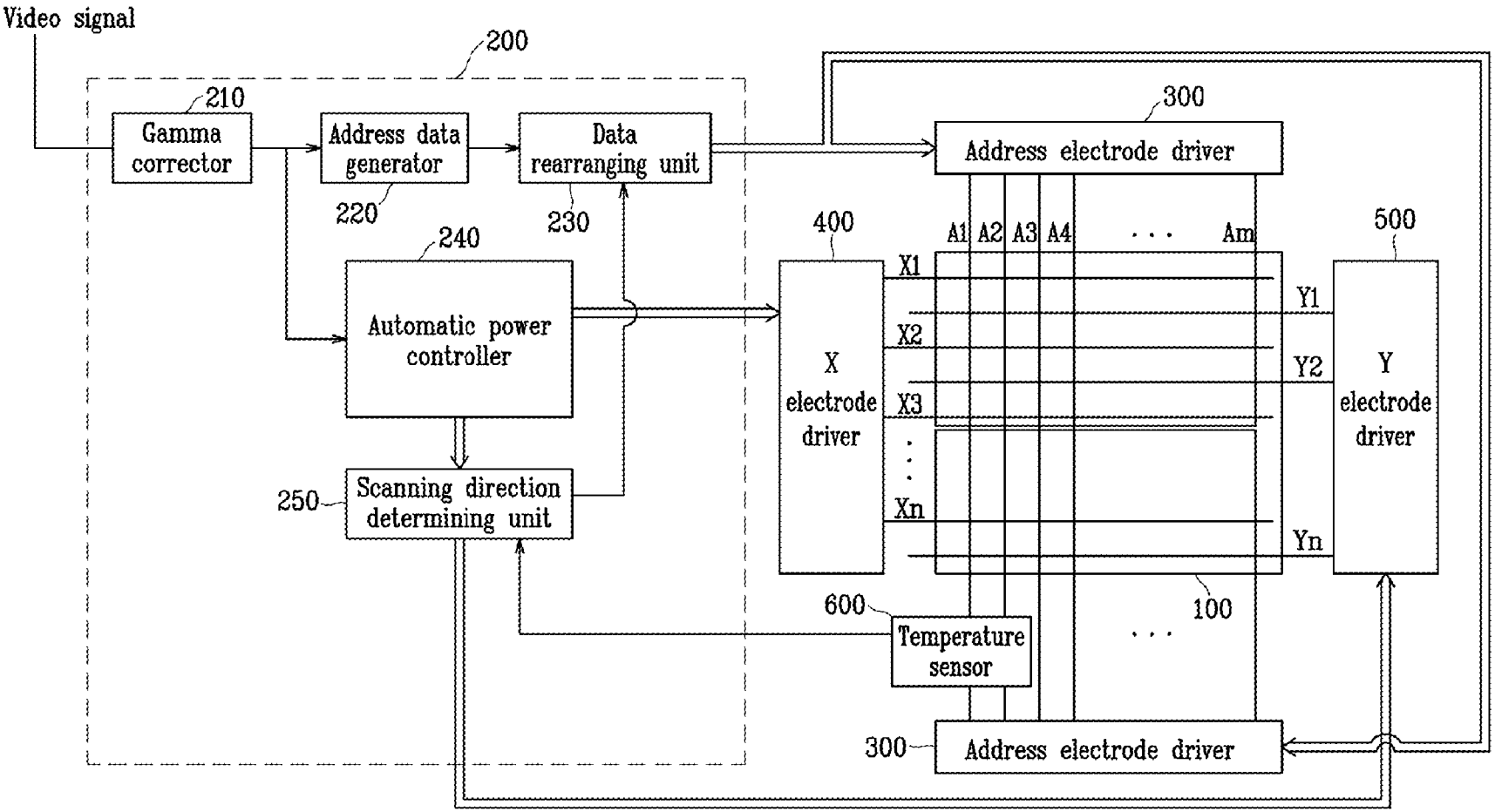
FIG. 1 shows a configuration of a plasma display panel according to a preferred embodiment of the present invention.

FIG. 1 shows a configuration of a PDP according to an embodiment of the present invention. Referring to FIG. 1, the PDP according to the invention includes a plasma panel 100, a controller 200, an address electrode driver 300, a sustain electrode driver (referred to as "X electrode driver" hereinafter) 400, a scan electrode driver (referred to as "Y electrode driver" hereinafter) 500, and a temperature sensor 600.

The plasma panel 100 includes a plurality of address electrodes A1 through Am arranged in the row direction, and a plurality of sustain electrodes (referred to as "X electrodes"hereinafter) $X_1$ hrough $X_n$ and scan electrodes (referred to as "Y electrodes" hereinafter) $Y_1$ through $Y_n$ arranged in the column direction. The X electrodes $X_1$ hrough $X_n$ respectively correspond to the Y electrodes $Y_1$ hrough $Y_n$, and in general, ends of the X electrodes $X_1$ through $X_n$ at one side are commonly connected. The plasma panel 100 further includes a glass substrate (not shown) on which the X electrodes $X_1$ hrough $X_n$ and the Y electrodes $Y_1$ hrough $Y_n$ are arranged, and a glass substrate (not shown) on which the address electrodes $A_1$ hrough $A_m$ are arranged. The two glass substrates face each other having a discharge space between them such that the X and Y electrodes $X_1$ hrough $X_n$ and $Y_1$ hrough $Y_n$ intersect the address electrodes $A_1$ through $A_m$. As shown, discharge cells are formed at the intersections of the address electrodes $A_1$ hrough $A_m$ and the X and Y electrodes $X_1$ hrough $X_n$ and $Y_1$ hrough $Y_n$.

The temperature sensor 600 primarily senses a temperature of the plasma panel 100, but may be configured to sense an external temperature, if required.

The controller 200 receives an external video signal and outputs an address electrode driving signal, an X electrode driving signal, and a Y electrode driving signal. In addition, the controller 200 determines a temperature sensed by the temperature sensor 600. When the sensed temperature is low or high, the controller 200 controls a Y electrode driving signal scanning direction to be changed and rearranges address data to output an address electrode driving signal corresponding to the rearranged address data. Furthermore, the controller 200 divides one frame into a plurality of sub-fields and drives the sub-fields if required. Each of the sub-fields includes a reset interval, an addressing interval, and a sustain interval.

The address electrode driver 300 receives the address electrode driving signal from the controller 200 and applies a display data signal for selecting discharge cells to be displayed to the address electrodes $A_1$ through $A_m$. The X electrode driver 400 receives the X electrode driving signal from the controller 200 and applies a driving voltage to the X electrodes $X_1$ hrough $X_n$. The Y electrode driver 500 receives the Y electrode driving signal from the controller 200 and supplies a driving voltage to the Y electrodes $Y_1$ hrough $Y_n$.

As shown in FIG. 1, the controller 200 includes a gamma corrector 210, an address data generator 220, a data rearranging unit 230, an automatic power controller 240, and a scanning direction determining unit 250.

The gamma corrector 210 receives a video signal and corrects a gamma value of the video signal on the basis of characteristics of the plasma display panel. The automatic power controller 240 measures an average signal level of video data output from the gamma corrector 210 and controls the power of the X electrode driving signal and Y electrode driving signal in response to the measured average signal level. The automatic power controller 240 divides the power-controlled data into N sub-fields if required and outputs the X electrode driving signal and Y electrode driving signal for each of the sub-fields.

The address data generator 220 generates address data from the video signal and outputs it as the address electrode driving signal. The scanning direction determining unit 250 controls a scanning direction of the Y electrode driving signal to be changed and outputs a control signal to the data rearranging unit 230 to rearrange the address data when the scanning direction determining unit 250 determines that a temperature sensed by the temperature sensor 600 is low. The data rearranging unit 230 rearranges the address data in response to the control signal output from the scanning direction determining unit 250 and outputs a Y electrode driving signal corresponding to the rearranged address data.

The operation of the plasma display panel having the above-described configuration according to one embodiment of the present invention will now be explained. A dual scanning technique that scans the plasma panel 100 from the top to the bottom of the plasma panel 100 at the normal temperature will be described in the following embodiment of the invention. Because the details of dual scanning are known in the art, a detailed explanation therefor is omitted. Given the following disclosure, such conventional dual scanning techniques may be adapted by a person of ordinary skill in the art to produce various embodiments of the invention.

Referring again to FIG. 1, the gamma corrector 210 of controller 200 receives an external video signal and corrects a gamma value of the video signal based on the individual characteristics of the PDP. Consequently, the gamma values will differ for each particular PDP.

The automatic power controller 240 measures an average signal level of the video data output from the gamma corrector 210, controls power in response to the measured average signal level to generate sustain pulse information, and respectively outputs, to the X electrode driver 400 and the scanning direction determining unit 250, an X electrode driving signal and a Y electrode driving signal that correspond to the sustain pulse information. In one embodiment, the automatic power controller 240 divides one frame into N sub-fields and generates the sustain pulse information for each of the sub-fields to provide the X electrode driving signal and Y electrode driving signal, if required.

The address data generator 220 generates address data from the video data output from the gamma corrector 210 and outputs it to the data rearranging unit 230.

The temperature sensor 600 senses an operating temperature of the plasma panel 100 (or an exterior operating temperature) and outputs the detected temperature to the scanning direction determining unit 250.

The scanning direction determining unit 250 determines whether the temperature sensed by the temperature sensor is high or low. Prior to operation of the PDP described above, a temperature at which poor discharging occurs is obtained experimentally, and is set to a first reference temperature as a basis of determining a low temperature. A different higher temperature may be experimentally determined and set to a second reference temperature as a basis of determining a high temperature. For example, temperatures lower than ten degrees centigrade may be determined to be low temperatures, and temperatures higher than fifty degrees centigrade may be determined to be high temperatures. Thus, various experiments may be made for one or more PDP's, of the same of similar types, to determine the PDP-specific low and high temperatures at which poor discharging occurs. The term "PDP-specific" means that the low and high temperatures at which poor discharging occurs may vary for each particular PDP tested. Consequently, the invention is not limited to the particular illustrative ranges of low and high temperatures listed above.

In one embodiment, when the sensed temperature is lower than a first reference temperature, the scanning direction determining unit 250 outputs the Y electrode driving signal such that the plasma panel is scanned from both ends to the center thereof. In addition, the scanning direction determining unit 250 outputs a control signal to the data rearranging unit 230 to rearrange the address data in response to the determined scanning direction.

In another embodiment, if the sensed temperature is higher than the second reference temperature (or a different reference temperature), the scanning direction determining unit 250 may determine that the sensed temperature lies above a range of normal operating temperatures, and output the Y electrode driving signal such that the plasma panel 100 is scanned from the top to is the bottom thereof. In addition, the scanning direction determining unit 250 outputs a control signal to the data rearranging unit 230 to output the address data as it is. For sensed temperatures that exceed a range of normal operating temperatures, either the top-to-bottom or end-to-center dual scanning techniques may be used in order to improve picture quality.

Illustratively, the data rearranging unit 230 may be configured to rearrange the address data only when a low temperature, indicated by the control signal of the scanning direction determining unit 250 is detected. Thus, in response to a detected low temperature, the data rearranging unit 230 outputs address electrode driving signal corresponding to the rearranged address data to the address electrode driver 300.

In response to the address electrode driving signal, the address electrode driver 300 applies a display data signal for selecting discharge cells to be displayed to the address electrodes $A_l$ through $A_m$.

The X electrode driver 400 receives the X electrode driving signal and applies a driving voltage to the X electrodes $X_l$ hrough $X_n$, and the Y electrode driver 500 supplies a driving voltage to the Y electrodes $Y_l$ hrough $Y_n$ according to the Y electrode driving signal.

A scanning direction based on a temperature is explained in more detail with reference to FIG. 2. Before continuing, however, it should be noted that, in general, the following phenomena may occur in the plasma display panel.

(1) If the temperature of the upper part of the plasma panel 100 is higher than its lower part when operating the plasma panel 100 a temperature difference between the upper and lower parts may become larger than ten degrees centigrade as the plasma panel 100 size increases. Consequently, when a large PDP operates at the normal temperature or at a temperature lower than the normal temperature, an increase in discharge delay results in poor address writing, which causes low discharge and poor image quality.

(2) The discharge delay increases when no priming particles are inside the plasma panel 100.

(3) As a scanning operation is retarded, the discharge delay becomes longer due to a variation in states of wall charges and space charges in the cells of the plasma panel 100.

(4) Unlike the case (3), the first scan line is the most vulnerable to discharge because it cannot receive a priming effect from a previous scanning operation.

In general, the plasma display panel is affected by the discharge delays of all the cases (1), (2), (3), and (4). Which phenomenon will affect a PDP during operation depends on a fabricating process used to manufacture the PDP or on one or more materials used to make the PDP. As shown in FIG. 2, the scanning direction is determined by taking into consideration the aforementioned four cases.

For example, when the plasma panel 100 (FIG. 1) is operated at the normal temperature for a predetermined period of time, the temperature of one part of the plasma panel 100 (illustratively the top part) increases, and a temperature difference may be generated between upper and lower parts of the plasma panel 100. Thus, the discharge delay is generated due to phenomena (1) and (2) so that low discharge occurs in the plasma panel 100. To provide a normal discharge, embodiments of the present invention provide a scanning direction from the upper part to the lower part of the plasma panel 100.

At the lower part of the plasma panel 100, a low temperature exists, and the phenomenon (4) becomes dominant. Thus, a first scan line (e.g., center line), becomes insufficiently discharged, and is unpleasant to the eye of a viewer. To reinstate a more pleasing picture, embodiments of the present invention scan the plasma panel 100 from bottom towards the top because the phenomenon (1) is not significant when the plasma panel 100 is operated at a low temperature. In this manner, dual scanning (top down for high temperature parts of the plasma panel 100 and bottom up for low temperature parts of the plasma panel 100) may be used to improve overall picture quality.

Figure 2:
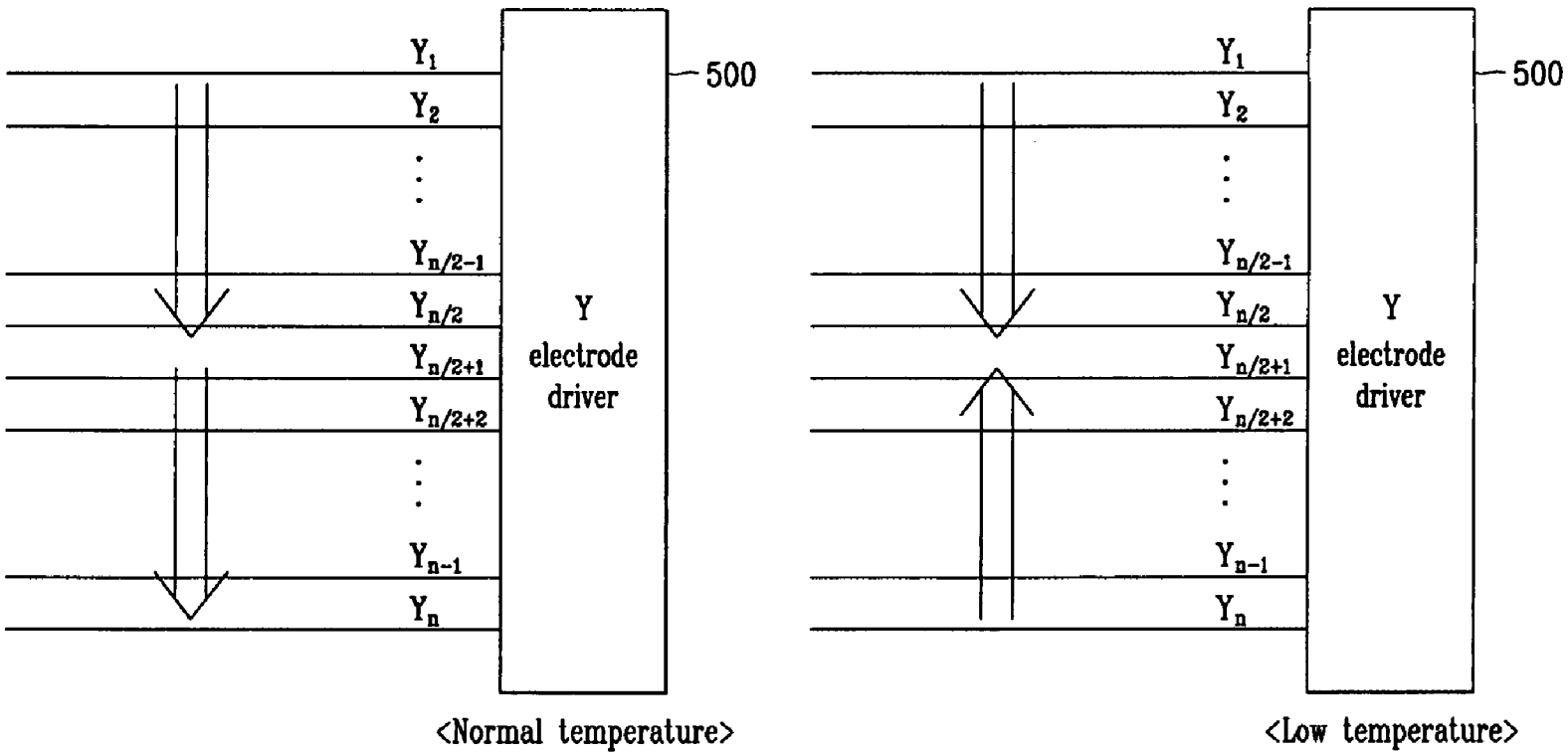
FIG. 2 shows a scanning direction of a plasma display panel based on a temperature according to a first embodiment of the present invention.

Referring now to FIG. 2, a PDP having a normal temperature is shown. At the normal temperature, dual scanning is carried out from the top to the bottom of the plasma panel 100 because the Y electrode driver 500 outputs the Y electrode driving signal in a normal fashion.

However, in an embodiment of the invention, in response to a detected low temperature in the lower part of the plasma panel 100, the Y electrode driver 500 outputs the Y electrode driving signal such that the scanning direction is changed, and dual scanning (top down for high temperature areas, and bottom up for low temperature areas) is executed from both ends to the center of the plasma panel 100.

As one of ordinary skill in the art will appreciate, there are various methods of changing the scanning direction according to the Y electrode driver 500 in response to the control signal of the scanning direction determining unit 250. For example, the scanning direction determining unit 250 may rearrange the Y electrode driving signal, or output a control signal to the Y electrode driver 500 to re-designate positions of Y electrodes to which the Y electrode driving signal is applied.

Additionally, the data rearranging method of the data rearranging unit 230 may be modified in various ways. If required, the functions of the data rearranging unit 230 and scanning direction determining unit 250 may be included in the address data generator 220 and automatic power controller 240.

In the aforementioned embodiment of the invention, even if poor discharge occurs in the first line at a low temperature, scanning is carried out from both ends of the plasma panel 100 so that picture quality is not largely deteriorated.

While dual scanning by the Y electrode driver 500 has been explained in the aforementioned embodiment, the present invention may also be applied to other scanning methods.

For example, a second embodiment of the present invention in which scanning direction is varied at the normal temperature and a high temperature will now be explained.

The configuration of the plasma display panel in the second embodiment of the invention is identical to that of the plasma display panel in the first embodiment, and only the functions of the scanning direction determining unit 250 and data rearranging unit 230 in the second embodiment are slightly different from those in the first embodiment.

In the second embodiment, the scanning direction determining unit 250 controls the scanning direction of the Y electrode driving signal to be changed and outputs a control signal to the data rearranging unit 230 to rearrange the address data when it determines that a temperature sensed by the temperature sensor 600 is low or high. The data rearranging unit 230 rearranges the address data in response to the control signal of the scanning direction determining unit 250 and outputs a Y electrode driving signal corresponding to the rearranged address data.

Figure 3:
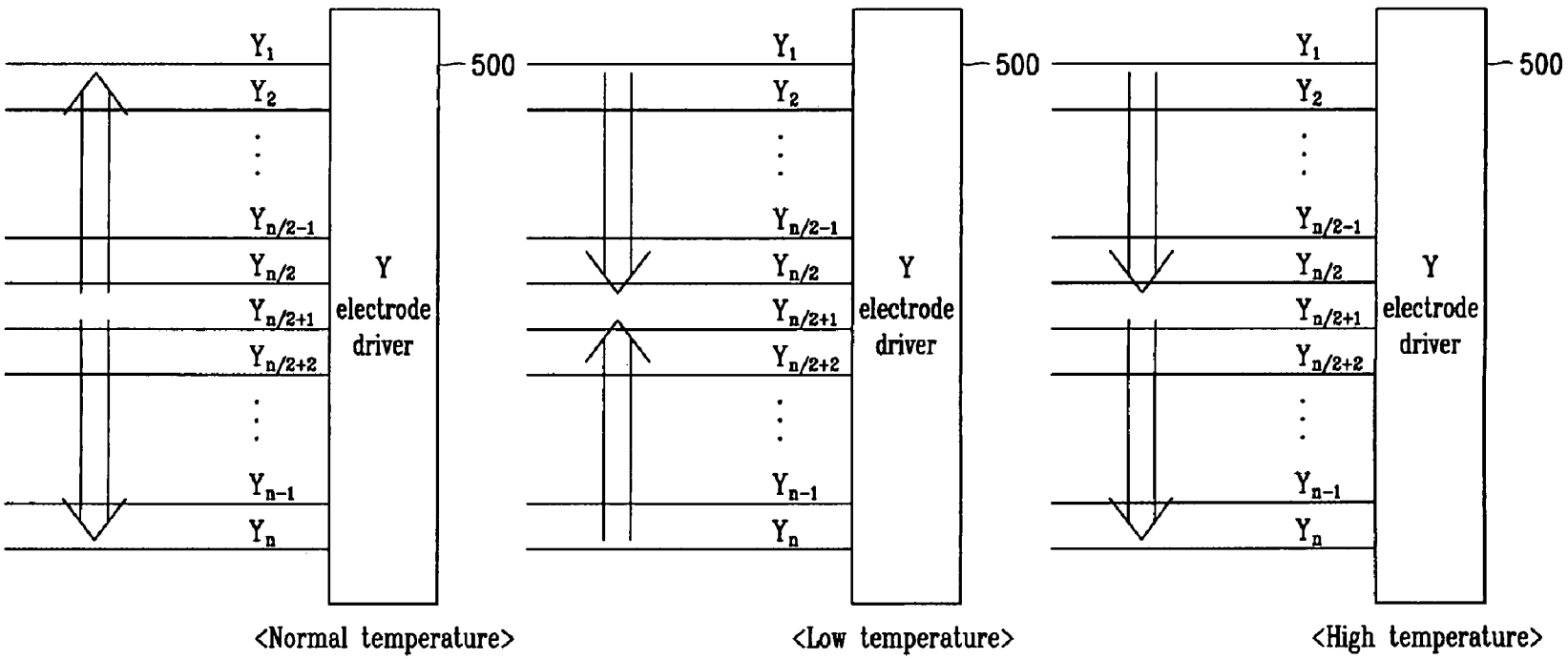
FIG. 3 shows a scanning direction of a plasma display panel based on a temperature according to a second embodiment of the present invention.

FIG. 3 shows a scanning direction of the plasma display panel based on a temperature according to the second embodiment of the present invention. Referring to FIG. 3, when the plasma display panel operates at the normal temperature for a predetermined period of time, the temperature of the plasma panel 100 increases to generate a temperature difference between upper and lower parts of the plasma panel 100. However, low discharge does not occur at the normal temperature even when there is a temperature difference. In this case, a luminance difference between the upper and lower parts of the plasma panel 100, caused by scanning from the center of the plasma panel 100, can be reduced by using dual scanning that starts from each end of the plasma panel 100 and moves towards the center.

At a low temperature, similar to the first embodiment, the phenomenon (4) becomes larger so that a center line, that is, the first scan line, becomes insufficiently discharged. Accordingly, the plasma panel 100 is scanned from both ends to the center thereof when the plasma panel 100 is operated at a low temperature. This can minimize the influence of low discharge of the first scan line on images.

At a high temperature, low discharge may occur in the plasma panel 100 when the discharge delay according to the phenomena (1) and (3) occurs. Accordingly, when high temperature is detected, embodiments of the invention alter the normal scan mode to scan from the top to the bottom of the plasma panel 100. On the other hand, when a normal operating temperature is detected, the Y electrode driver 500 outputs the Y electrode driving signal such that dual scanning is carried out from the center to both ends of the plasma panel 100.

Referring to FIG. 3, a low temperature is detected, and the Y electrode driver 500 outputs the Y electrode driving signal in a scanning direction opposite to the scanning direction at the normal temperature such that dual scanning is carried out from both ends to the center of the plasma panel 100. As mentioned previously, there are various methods of changing the scanning direction by the Y electrode driver 500 in response to the control signal of the scanning direction determining unit 250.

At a high temperature, the Y electrode driver 500 outputs the Y electrode driving signal in the same scanning direction as the scanning direction as the normal temperature in the first embodiment such that dual scanning is carried out from the top to the bottom of the plasma panel 100.

In one embodiment, the plasma display panel may be configured such that the controller carries out dual scanning on the plasma panel 100 from a center of the plasma panel 100 to each end thereof when the temperature sensed by the temperature sensor is higher than a first reference temperature and lower than a second temperature.

As described above, the present invention may change the scanning direction at a high or low temperature to prevent picture quality from being deteriorated due to poor sustain discharge. Furthermore, the present invention may remove a luminance difference between upper and lower parts of a plasma panel without reducing a margin of the plasma panel.

While this invention has been described in connection with what is presently considered to be the most practical and preferred embodiment, it is to be understood that the invention is not limited to the disclosed embodiments, but, also covers various modifications and equivalent arrangements included within the spirit and scope of the appended claims.

What is claimed is:

1. A plasma display panel that receives external video data and displays gray scales through dual scanning, comprising:

a plasma panel including a plurality of address electrodes, a plurality of scan electrodes, and a plurality of sustain electrodes;

a temperature sensor for sensing a temperature of the plasma panel;

a controller that receives video data to generate an address electrode driving signal, a sustain electrode driving signal, and a scan electrode driving signal, the controller controlling a scanning direction to be changed to scan the plasma panel from both ends to the center of the panel and rearranging the address electrode driving signal to correspond to the controlled scanning direction when the temperature sensed by the temperature sensor is lower than a first temperature;

an address electrode driver that applies a voltage corresponding to the address electrode driving signal to the address electrodes;

a sustain electrode driver that applies a sustain voltage to the sustain electrodes in response to the sustain electrode driving signal of the controller; and a scan electrode driver that determines a scanning direction according to a control signal of the controller and applies a voltage to the scan electrodes in response to the scan electrode driving signal.

2. The plasma display panel of claim 1, wherein the controller controls the scanning direction to scan the plasma panel from a top to a bottom thereof when the temperature sensed by the temperature sensor is higher than the first temperature.

3. The plasma display panel of claim 2, wherein the first temperature that is a basis for determining a low temperature is experimentally set to a temperature at which poor discharge occurs.

4. The plasma display panel of claim 1, wherein the controller comprises:

a gamma corrector for receiving the video data and correcting a gamma value of the video data on the basis of characteristics of the plasma display panel;

an automatic power controller for measuring an average signal level of the video data output from the gamma corrector and controlling the power of a X electrode driving signal and a Y electrode driving signal according to the measured average signal level;

an address data generator for generating address data from the video data and outputting the address data as the address electrode driving signal;

a scanning direction determining unit that rearranges the Y electrode driving signal to change the scanning direction and outputs a control signal to rearrange the address data when the temperature sensed by the temperature sensor is lower than the first temperature or higher than a second temperature, the second temperature being higher than the first temperature; and a data rearranging unit for rearranging the address data in response to the control signal of the scanning direction determining unit and outputting a Y electrode driving signal that corresponds to the rearranged address data.

5. A plasma display panel that receives external video data and displays gray scales, comprising:

a plasma panel including a plurality of address electrodes, a plurality of scan electrodes, and a plurality of sustain electrodes;

a temperature sensor for sensing a temperature of the plasma panel;

a controller that receives video data to generate an address electrode driving signal, a sustain electrode driving signal, and a scan electrode driving signal, and controls a scanning direction to be changed when the temperature sensed by the temperature sensor is lower than a first temperature or higher than a second temperature, the second temperature being higher than the first temperature;

an address electrode driver that applies a voltage corresponding to the address electrode driving signal to the address electrodes;

a sustain electrode driver that applies a sustain voltage to the sustain electrodes in response to the sustain electrode driving signal of the controller; and a scan electrode driver that determines a scanning direction according to a control signal of the controller and applies a voltage to the scan electrodes in response to the scan electrode driving signal.

6. The plasma display panel of claim 5, wherein the controller carries out dual scanning on the plasma panel from a center of the panel to each end thereof when the temperature sensed by the temperature sensor is higher than the first temperature and lower than the second temperature.

7. The plasma display panel of claim 5, wherein the controller controls the plasma panel to be scanned from both ends to the center thereof when the temperature sensed by the temperature sensor is lower than the first temperature, and controls the plasma panel to be scanned from the top to the bottom thereof when the temperature sensed by the temperature sensor is higher than the second temperature.

8. The plasma display panel of claim 7, wherein the first temperature that is a basis for determining a low temperature is experimentally set to a temperature at which poor discharge occurs, and the second temperature that is a basis for determining a high temperature is experimentally set to a different higher temperature at which poor discharge occurs.

9. The plasma display panel of claim 5, wherein the controller comprises:

a gamma corrector for receiving the video data and correcting a gamma value of the video data on the basis of characteristics of the plasma display panel;

an automatic power controller for measuring an average signal level of the video data output from the gamma corrector and controlling the power of a X electrode driving signal and a Y electrode driving signal according to the measured average signal level;

an address data generator for generating address data from the video data and outputting the address data as the address electrode driving signal;

a scanning direction determining unit that outputs a control signal to change a scanning direction of the Y electrode driving signal and outputs a control signal to rearrange the address data when the temperature sensed by the temperature sensor is lower than the first temperature or higher than the second temperature; and a data rearranging unit for rearranging the address data in response to the control signal of the scanning direction determining unit and outputting a Y electrode driving signal that corresponds to the rearranged address data.

10. A method for driving a plasma display panel that includes a plurality of address electrodes and a plurality of scan electrodes and sustain electrodes, and that displays video data through dual scanning, comprising:

sensing a temperature of the plasma display panel;

receiving external video data to generate an address electrode driving signal, a sustain electrode driving signal, and a scan electrode driving signal;

controlling a scanning direction to be changed to scan the plasma display panel from both ends to the center thereof and rearranging the address electrode driving signal in response to the controlled scanning direction when the sensed temperature is lower than a first temperature; and applying the rearranged address electrode driving signal to the address electrodes, applying a sustain voltage to the sustain electrodes in response to the sustain electrode driving signal, and applying a voltage to the scan electrodes according to the scan electrode driving signal in response to a control signal.

11. The method of claim 10, wherein sensing a temperature of the plasma display panel senses a temperature of an interior of the plasma display panel.

12. The method of claim 10, wherein sensing a temperature of the plasma display panel senses a temperature exterior to the plasma display panel.

13. The method of claim 10, further comprising:

controlling the scanning direction to scan the plasma display panel from a top to a bottom thereof and rearranging the address electrode driving signal in response to the controlled scanning direction when the sensed temperature is higher than the first temperature.

14. The method of claim 10, further comprising:

controlling the scanning direction to scan the plasma display panel from the top to the bottom thereof when the sensed temperature is higher than a second temperature, and controlling the scanning direction to scan the plasma display panel from the center to both ends thereof when the sensed temperature is lower than the second temperature and higher than the first temperature, the second temperature being higher than the first temperature.

15. The method of claim 14, wherein the first temperature that is a basis for determining a low temperature is experimentally set to a temperature at which poor discharge occurs, and the second temperature that is a basis for determining a high temperature is experimentally set to a different higher temperature at which poor discharge occurs.

* * * * *